US008961331B2

(12) United States Patent
Shiga et al.

(10) Patent No.: US 8,961,331 B2
(45) Date of Patent: Feb. 24, 2015

(54) GOLF CLUB SHAFT

(71) Applicant: Dunlop Sports Co. Ltd., Kobe-shi, Hyogo (JP)

(72) Inventors: Kazuyoshi Shiga, Kobe (JP); Yasuo Naito, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 0 days.

(21) Appl. No.: 13/905,191

(22) Filed: May 30, 2013

(65) Prior Publication Data

US 2013/0324288 A1 Dec. 5, 2013

(30) Foreign Application Priority Data

May 31, 2012 (JP) ..... 2012-125371

(51) Int. Cl.
*A63B 53/10* (2006.01)
*A63B 59/00* (2006.01)

(52) U.S. Cl.
CPC ..... *A63B 53/10* (2013.01); *A63B 59/0074* (2013.01); *A63B 59/0092* (2013.01); *A63B 2209/023* (2013.01); *A63B 2209/026* (2013.01); *A63B 2225/02* (2013.01)
USPC ..... 473/319

(58) Field of Classification Search
USPC ..... 473/319
See application file for complete search history.

(56) References Cited

U.S. PATENT DOCUMENTS 4,212,461 A * 7/1980 Cecka et al. ..... 473/535

FOREIGN PATENT DOCUMENTS

JP 2000-093568 A 4/2000

* cited by examiner

*Primary Examiner* — Michael Dennis
(74) *Attorney, Agent, or Firm* — Birch, Stewart, Kolasch & Birch, LLP

(57) ABSTRACT

A shaft 6 has a plurality of full length layers s2, s3, and s6 to s9. The full length layers have full length bias layers s2 and s3, and full length straight layers s6, s8, and s9. The full length straight layers s6, s8, s9 located outside the full length bias layers s2 and s3 include a novolac-containing layer. In the novolac-containing layer, a content Rn of the novolac type epoxy resin is 3% by mass or greater and 19% by mass or less. If an average specific gravity of the novolac-containing layers constituting the full length straight layers is defined as S1, and an average specific gravity of the full length bias layers and inside of the full length bias layers is defined as S2, the specific gravity S1 is greater than the specific gravity S2.

16 Claims, 9 Drawing Sheets

GOLF CLUB SHAFT

The present application claims priority on Patent Application No. 2012-125371 filed in JAPAN on May 31, 2012, the entire contents of which are hereby incorporated by reference.

BACKGROUND OF THE INVENTION

1. Field of the Invention

The present invention relates to a golf club shaft.

2. Description of the Related Art

A lightweight golf club shaft has been required in respect of increasing a head speed. Japanese Patent Application Laid-Open No. 2000-93568 discloses a lightweight golf club shaft having a high strength.

SUMMARY OF THE INVENTION

The weight saving of a carbon shaft can be attained by reducing a matrix resin. However, the weight reduction of the matrix resin approaches the limit.

Meanwhile, the tensile elastic modulus of a fiber is increased and a fiber amount is reduced, thereby enabling the weight saving of the carbon shaft while maintaining the rigidity thereof. However, in this case, the strength of the carbon shaft is decreased.

It is an object of the present invention to provide a lightweight golf club shaft having a high strength.

A shaft of the present invention is a laminate including a fiber-reinforced resin layer. The shaft has a plurality of full length layers. The full length layers have full length bias layers and full length straight layers. If a layer having a matrix resin including a novolac type epoxy resin is defined as a novolac-containing layer, the full length straight layers located outside the full length bias layers include the novolac-containing layer. In the novolac-containing layer, the matrix resin includes an epoxy resin component. A content Rn of the novolac type epoxy resin in the epoxy resin component is 3% by mass or greater and 19% by mass or less. If an average specific gravity of the novolac-containing layer(s) constituting the full length straight layer(s) is defined as S1, and an average specific gravity of the full length bias layers and inside of the full length bias layers is defined as S2, the specific gravity S1 is greater than the specific gravity S2.

Preferably, the full length straight layers have an outermost full length straight layer located on the outermost side among the full length layers. Preferably, the outermost full length straight layer is the novolac-containing layer.

Preferably, N layers located on the outermost side among the full length straight layers are the novolac-containing layers. Preferably, the N is equal to or greater than 2.

Preferably, the N is equal to or greater than 3.

Preferably, the M full length straight layer(s) which is/are the novolac-containing layer(s) is/are provided. Preferably, all the M layer (s) are located on the outermost side among the full length layers.

Preferably, a fiber elastic modulus of the novolac-containing layer located outside the full length bias layers is equal to or greater than 8 t/mm$^2$ and less than 38 t/mm$^2$. Preferably, a fiber elastic modulus of the full length bias layer is 38 t/mm$^2$ or greater and 70 t/mm$^2$ or less.

Preferably, fiber elastic modulus(es) of all layer(s) located inside the full length bias layers is/are 38 t/mm$^2$ or greater and 70 t/mm$^2$ or less.

DESCRIPTION OF THE PREFERRED EMBODIMENTS

Figure 1:
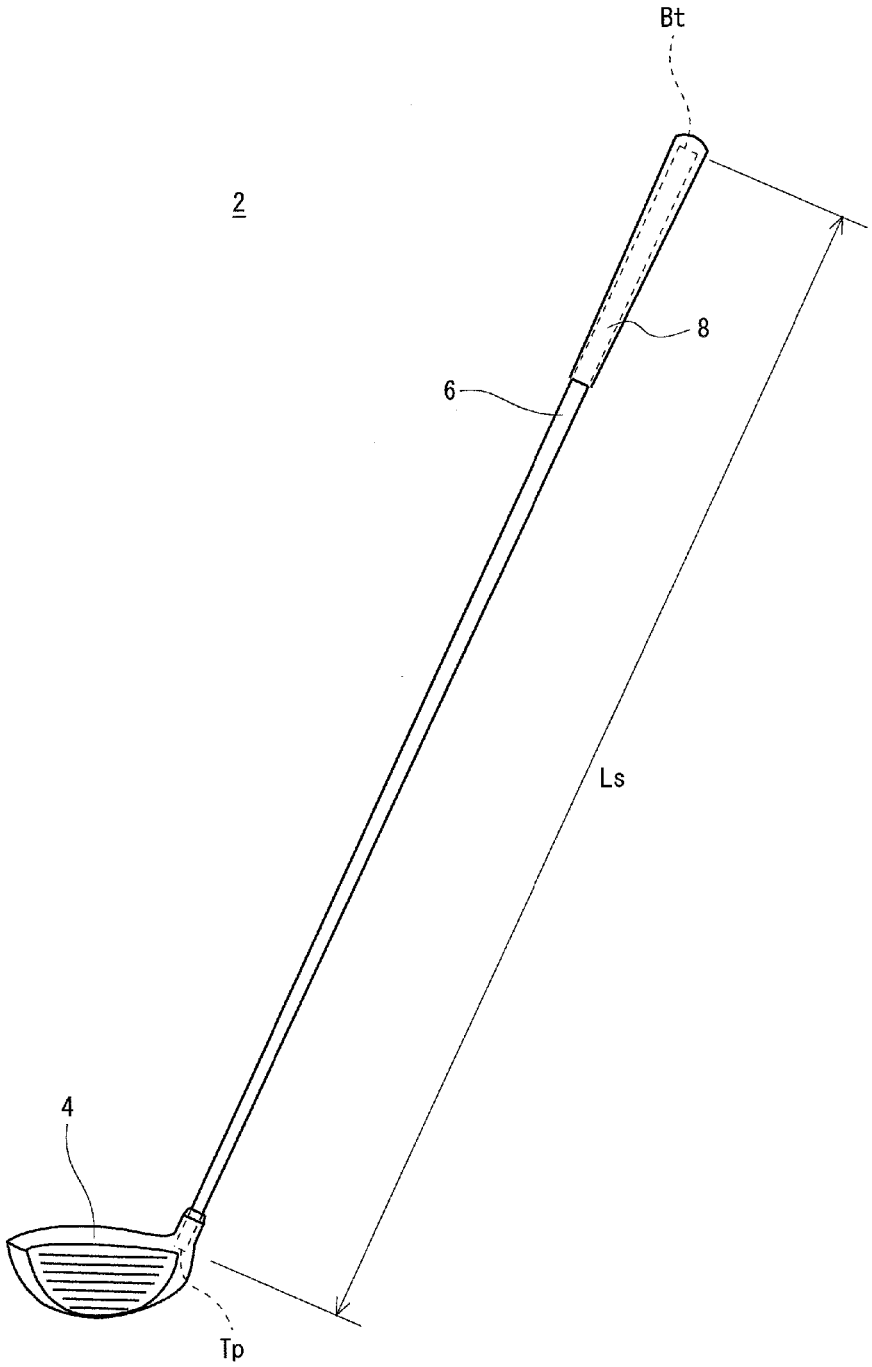
FIG. 1 shows a golf club including a shaft according to one embodiment of the present invention.

Hereinafter, the present invention will be described in detail based on preferred embodiments with appropriate references to the drawings.

The term "layer" and the term "sheet" are used in the present application. The "layer" is wound. Meanwhile, the "sheet" is not wound. The "layer" is formed by winding the "sheet". That is, the wound "sheet" forms the "layer". In the present application, the same reference numeral is used in the layer and the sheet. For example, a layer formed by a sheet s1 is defined as a layer s1.

In the present application, an "inside" means an inside in a radial direction of a shaft. In the present application, an "outside" means an outside in the radial direction of the shaft.

In the present application, an "axis direction" means an axis direction of the shaft.

In the present application, an angle Af and an absolute angle θa are used for the angle of a fiber to the axis direction. The angle Af is a positive or negative angle. The absolute angle θa is the absolute value of the angle Af. In other words, the absolute angle θa is the absolute value of an angle between the axis direction and the direction of the fiber. For example, "the absolute angle θa is equal to or less than 10 degrees" means that "the angle Af is −10 degrees or greater and +10 degrees or less".

FIG. 1 shows a golf club 2 including a golf club shaft 6 according to one embodiment of the present invention. The golf club 2 includes a head 4, a shaft 6, and a grip 8. The head 4 is provided at the part of the shaft 6. The grip 8 is provided at the butt end part of the shaft 6. The head 4 and the grip 8 are not limited. Examples of the head 4 include a wood type golf club head, a hybrid type golf club head, a utility type golf club head, an iron type golf club head, and a putter head.

The head 4 of the embodiment is a wood type golf club head. In a comparatively long club, the effect of an improvement of a flight distance caused by the weight saving of the shaft is high. In this respect, the wood type golf club head, the hybrid type golf club head, and the utility type golf club head are preferable as the head 4. A hollow head has a large moment of inertia. A club with a head having a large moment of inertia stably has an effect of improving a flight distance. In this respect, the head 4 is preferably hollow.

The material of the head 4 is not limited. Examples of the material of the head 4 include titanium, a titanium alloy, CFRP (carbon fiber-reinforced plastic), stainless steel, maraging steel, and soft iron. A plurality of materials can also be combined. For example, the CFRP and the titanium alloy can be combined. In respect of lowering the center of gravity of the head, the head may have a crown of which at least a part is made of CFRP and a sole of which at least a part is made of a titanium alloy. In respect of a strength, the whole of the face is preferably made of a titanium alloy.

The shaft 6 includes a laminate including a fiber-reinforced resin layer. The shaft 6 is a tubular body. The shaft 6 has a hollow structure. As shown in FIG. 1, the shaft 6 has a tip and Tp and a butt end Bt. The tip end Tp is located in the head 4. The butt end Bt is located in the grip 8.

The shaft 6 is a so-called carbon shaft. The shaft 6 is preferably obtained by curing a prepreg sheet. In the prepreg sheet, a fiber is oriented substantially in one direction. The prepreg in which the fiber is oriented substantially in one direction is also referred to as a UD prepreg. The "UD" stands for unidirection. Prepregs other than the UD prepreg may be used. For example, fibers contained in the prepreg sheet may be woven. The prepreg will be described in detail later.

The prepreg sheet has a fiber and a resin. The resin is also referred to as a matrix resin. The fiber is typically a carbon fiber. The matrix resin is typically a thermosetting resin.

The shaft 6 is manufactured by a so-called sheet winding process. In the prepreg, the matrix resin is in a semicured state. The shaft 6 is obtained by winding and curing the prepreg sheet. The curing means the curing of the semicured matrix resin. The curing is performed by heating. The manufacturing process of the shaft 6 includes a heating process. The heating process cures the matrix resin of the prepreg sheet.

Figure 2:
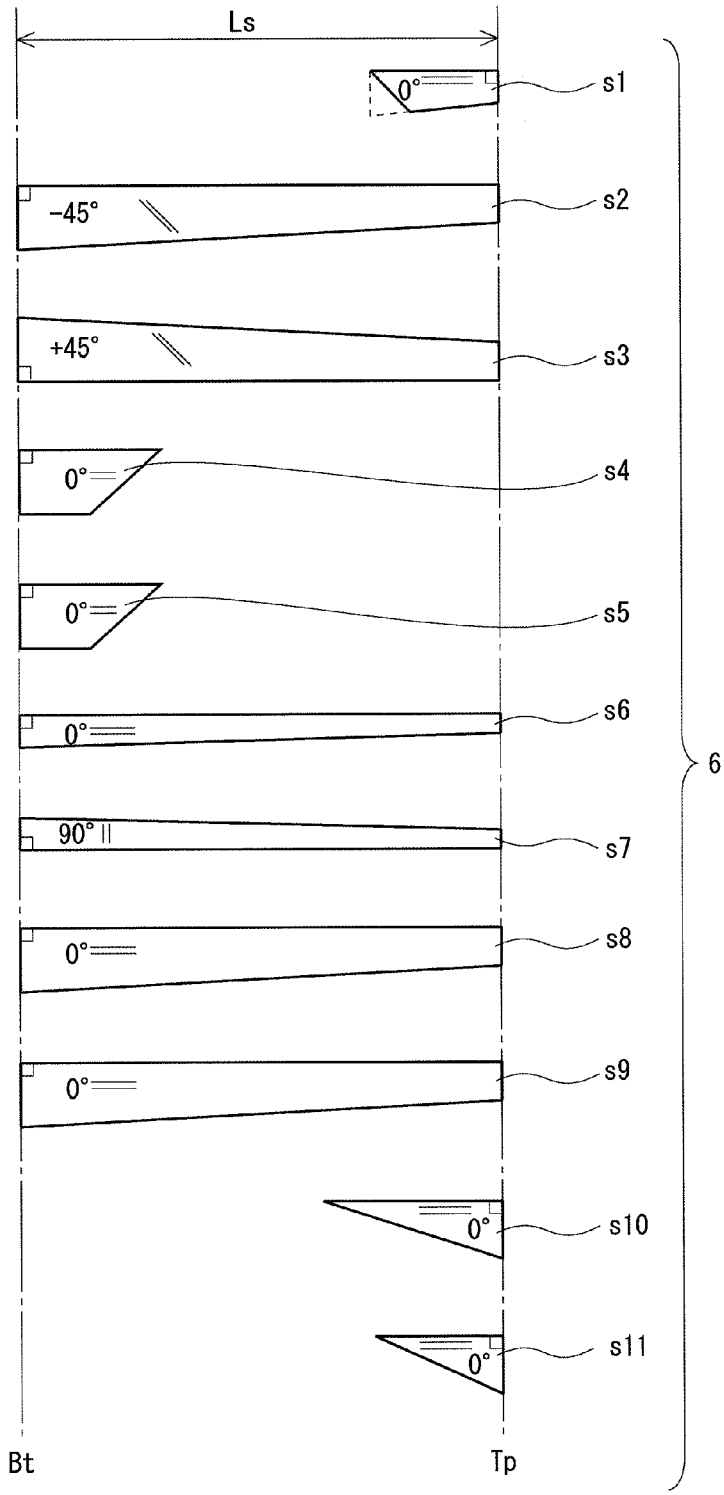
FIG. 2 is a developed view of the shaft according to the embodiment of FIG. 1.

FIG. 2 is a developed view (sheet constitution view) of the prepreg sheets constituting the shaft 6. The shaft 6 includes a plurality of sheets. In the embodiment of FIG. 2, the shaft 6 includes eleven sheets s1 to s11. In the present application, the developed view shown in FIG. 2 or the like shows the sheets constituting the shaft in order from the radial inside of the shaft. The sheets are wound in order from the uppermost sheet in the developed view. If a united sheet is formed by stacking, the sheets are wound in the state of the united sheet. In the developed view of the present application, the horizontal direction of the figure coincides with the axis direction of the shaft. In the developed view of the present application, the right side of the figure is the tip end Tp side of the shaft. In the developed view of the present application, the left side of the figure is the butt end Bt side of the shaft.

The developed view of the present application shows not only the winding order of each of the sheets but also the disposal of each of the sheets in the axis direction of the shaft. For example, in FIG. 2, the end of the sheet s1 is located at the tip end Tp. For example, in FIG. 2, the ends of the sheets s4 and s5 are located at the butt end Bt.

The shaft 6 has a straight layer, a bias layer, and a hoop layer. The orientation angle of the fiber is described in the developed view of the present application. A sheet described as "0 degree" constitutes the straight layer. The sheet for the straight layer is also referred to as a straight sheet in the present application.

The straight layer is a layer in which the orientation direction of the fiber is substantially set to 0 degree to the longitudinal direction of the shaft (the axis direction of the shaft). The orientation of the fiber may not be completely set to 0 degree to the axis direction of the shaft by an error or the like in winding. Usually, in the straight layer, the absolute angle θa is equal to or less than 10 degrees.

In the embodiment of FIG. 2, the straight sheets are the sheet s1, the sheet s4, the sheet s5, the sheet s6, the sheet s8, the sheet s9, the sheet s10, and the sheet s11. The straight layer is highly correlated with the flexural rigidity and flexural strength of the shaft.

Meanwhile, the bias layer is highly correlated with the torsional rigidity and torsional strength of the shaft. Preferably, the bias layer includes two sheets in which orientation angles of fibers are inclined in opposite directions to each other. In respect of the torsional rigidity, the absolute angle θa of the bias layer is preferably equal to or greater than 15 degrees, more preferably equal to or greater than 25 degrees, and still more preferably equal to or greater than 40 degrees. In respects of the torsional rigidity and the flexural rigidity, the absolute angle θa of the bias layer is preferably equal to or less than 60 degrees, and more preferably equal to or less than 50 degrees.

In the shaft 6, the sheets constituting the bias layer are the sheet s2 and the sheet s3. In FIG. 2, the angle Af is described in each sheet. The plus (+) and minus (−) in the angle Af show that the fibers of bias sheets are inclined in opposite directions to each other. In the present application, the sheet for the bias layer is also merely referred to as the bias sheet.

In the embodiment of FIG. 2, the angle of the sheet s2 is −45 degrees and the angle of the sheet s3 is +45 degrees. However, conversely, it should be appreciated that the angle of the sheet s2 may be +45 degrees and the angle of the sheet s3 may be −45 degrees.

In the shaft 6, the sheet constituting the hoop layer is the sheet s7. Preferably, the absolute angle θa in the hoop layer is substantially 90 degrees to a shaft axis line. However, the orientation direction of the fiber to the axis direction of the shaft may not be completely set to 90 degrees by an error or the like in winding. Usually, in the hoop layer, the absolute angle θa is 80 degrees or greater and 90 degrees or less. In the present application, the prepreg sheet for the hoop layer is also referred to as a hoop sheet.

The hoop layer contributes to the increase in the crushing rigidity and crushing strength of the shaft. The crushing rigidity is rigidity to a force crushing the shaft toward the inside of the radial direction thereof. The crushing strength is a strength to a force crushing the shaft toward the inside of the radial direction thereof. The crushing strength can be also involved with the flexural strength. Crushing deformation can be generated with flexural deformation. In a particularly thin lightweight shaft, this interlocking property between the crushing deformation and the flexural deformation is large. The increase in the crushing strength also can cause the increase in the flexural strength.

Although not shown in the drawings, the prepreg sheet before being used is usually sandwiched between cover sheets. The cover sheets are usually a mold release paper and a resin film. That is, the prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a mold release paper side surface", and the surface on which the resin film is applied is also referred to as "a film side surface".

In the developed view of the present application, the film side surface is the front side. That is, in the developed view of the present application, the front side of the figure is the film side surface, and the back side of the figure is the mold release paper side surface. For example, in FIG. 2, the direction of the fiber of the sheet s2 is the same as that of the sheet s3. However, the sheet s3 is reversed when the sheet s3 is stacked as described later. As a result, the directions of the fibers of the sheets s2 and s3 are opposite to each other. Therefore, in the state after being wound, the directions of the fibers of the sheets s2 and s3 are opposite to each other. In light of this point, in FIG. 2, the direction of the fiber of the sheet s2 is described as "−45 degrees", and the direction of the fiber of the sheet s3 is described as "+45 degrees".

In order to wind the prepreg sheet, the resin film is first peeled. The film side surface is exposed by peeling the resin film. The exposed surface has tacking property (tackiness). The tacking property is caused by the matrix resin. Since the matrix resin is in a semicured state, the tackiness is developed. Next, the edge part of the exposed film side surface (also referred to as a winding start edge part) is applied on a wound object. The winding start edge part can be smoothly applied by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is first peeled. Next, the winding start edge part is applied on the wound object, and the mold release paper is then peeled. That is, the resin film is first peeled. After the winding start edge part is applied an the wound object, the mold release paper is peeled. The procedure suppresses the wrinkles and winding fault of the sheet. This is because the sheet on which the mold release paper is applied is supported by the mold release paper, and causes less wrinkle. The mold release paper has flexural rigidity higher than that of the resin film.

A united sheet is used in the embodiment of FIG. 2. The united sheet is formed by stacking two or more sheets.

Figure 3:
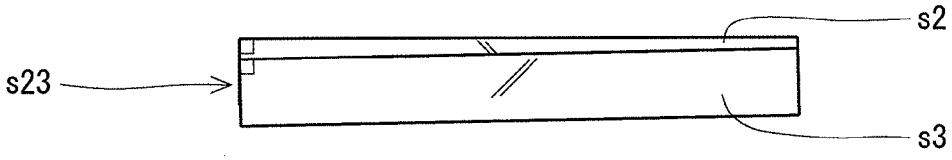
FIG. 3 is a plan view showing a first united sheet according to the shaft of FIG. 2.
Figure 4:
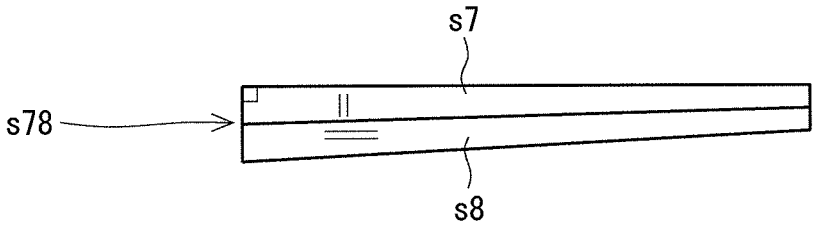
FIG. 4 is a plan view showing a second united sheet according to the shaft of FIG. 2.

The two united sheets are formed in the embodiment of FIG. 2. FIG. 3 shows a first united sheet s23. This united sheet s23 is formed by stacking the sheet s2 and the sheet s3. FIG. 4 shows a second united sheet s78. The united sheet s78 is formed by stacking the sheet s7 and the sheet s8.

The sheet s2 and the sheet s3 are deviated for a half circle in the united sheet s23. That is, in the shaft after being wound, the circumferential position of the sheet s2 and the circumferential position of the sheet s3 are different from each other in the circumferential direction. The difference angle is preferably 180 degrees (±15 degrees).

As a result of using the united sheet s23, a first bias layer s2 and a second bias layer s3 are deviated from each other in the circumferential direction. The positions of the ends of the bias layers are dispersed in the circumferential direction by the deviation. The dispersion improves the uniformity of the shaft in the circumferential direction.

As shown in FIG. 4, in the second united sheet s78, the upper end of the sheet s7 coincides with the upper end of the sheet s8. In the sheet s78, the whole of the sheet s7 is applied on the sheet s8. Therefore, the winding fault of the sheet s7 is suppressed in the winding process.

As described above, in the present application, the sheets and the layers are classified by the orientation angle of the fiber. Furthermore, in the present application, the sheets and the layers are classified by the length of the axis direction of the shaft.

In the present application, a layer disposed all over in the axis direction of the shaft is referred to as a full length layer. In the present application, a sheet disposed all over in the axis direction of the shaft is referred to as a full length sheet. The wound full length sheet forms the full length layer.

Meanwhile, in the present application, a layer partially disposed in the axis direction of the shaft is referred to as a partial layer. In the present application, a sheet partially disposed in the axis direction of the shaft is referred to as a partial sheet. The wound partial sheet forms the partial layer.

In the present application, the full length layer which is the straight layer is referred to as a full length straight layer. In the embodiment of FIG. 2, the full length straight layers are the sheet s6, the sheet s8, and the sheet s9.

In the present application, the full length layer which is the hoop layer is referred to as a full length hoop layer. In the embodiment of FIG. 2, the full length hoop layer is the sheet s7.

In the present application, the partial layer which is the straight layer is referred to a partial straight layer. In the embodiment of FIG. 2, the partial straight layers are the sheet s1, the sheet s4, the sheet s5, the sheet s10, and the sheet s11.

The shaft 6 is produced by the sheet winding process using the sheets shown in FIG. 2.

Hereinafter, the manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

A plurality of sheets are stacked in the stacking process. In the embodiment, the above-mentioned united sheets s23 and s78 are produced.

In the stacking process, heating or pressing may be performed. More preferably, the heating and pressing are performed in combination. In a winding process to be described later, the deviation of the sheet may be produced during the winding operation of the united sheet. The deviation reduces winding accuracy. The heating and the pressing improve an adhesive force between the sheets. The heating and the pressing suppress the deviation between the sheets in the winding process.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet on the mandrel.

The sheets to be stacked are wound in a state of the united sheet.

A winding body is obtained by the winding process. The winding body is obtained by winding the prepreg sheet around the outside of the mandrel. For example, the winding is performed by rolling the wound object on a plane. The winding may be performed by a manual operation or a machine. The machine is referred to as a rolling ng machine.

(4) Tape Wrapping Process

A tape is wound around the outer peripheral surface of the winding body in the tape wrapping process. The tape is also referred to as a wrapping tape. The wrapping tape is wound while tension is applied to the wrapping tape. The wrapping tape is spirally wound at a predetermined pitch. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not limited. However, the process of removing the wrapping tape is preferably performed after the process of extracting the mandrel in respect of improving the efficiency of the process of removing the wrapping tape.

(7) Process of Cutting Both Ends

The both end parts of the cured laminate are cut in the process. The cutting flattens the end face of the tip end Tp and the end face of the butt end Bt.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to smoothen the surface of the cured laminate.

(9) Coating Process

The cured laminate after the polishing process is subjected to coating.

The head 4 and the grip 8 are attached to the shaft 6 thus manufactured, to obtain the golf club 2.

Figure 5:
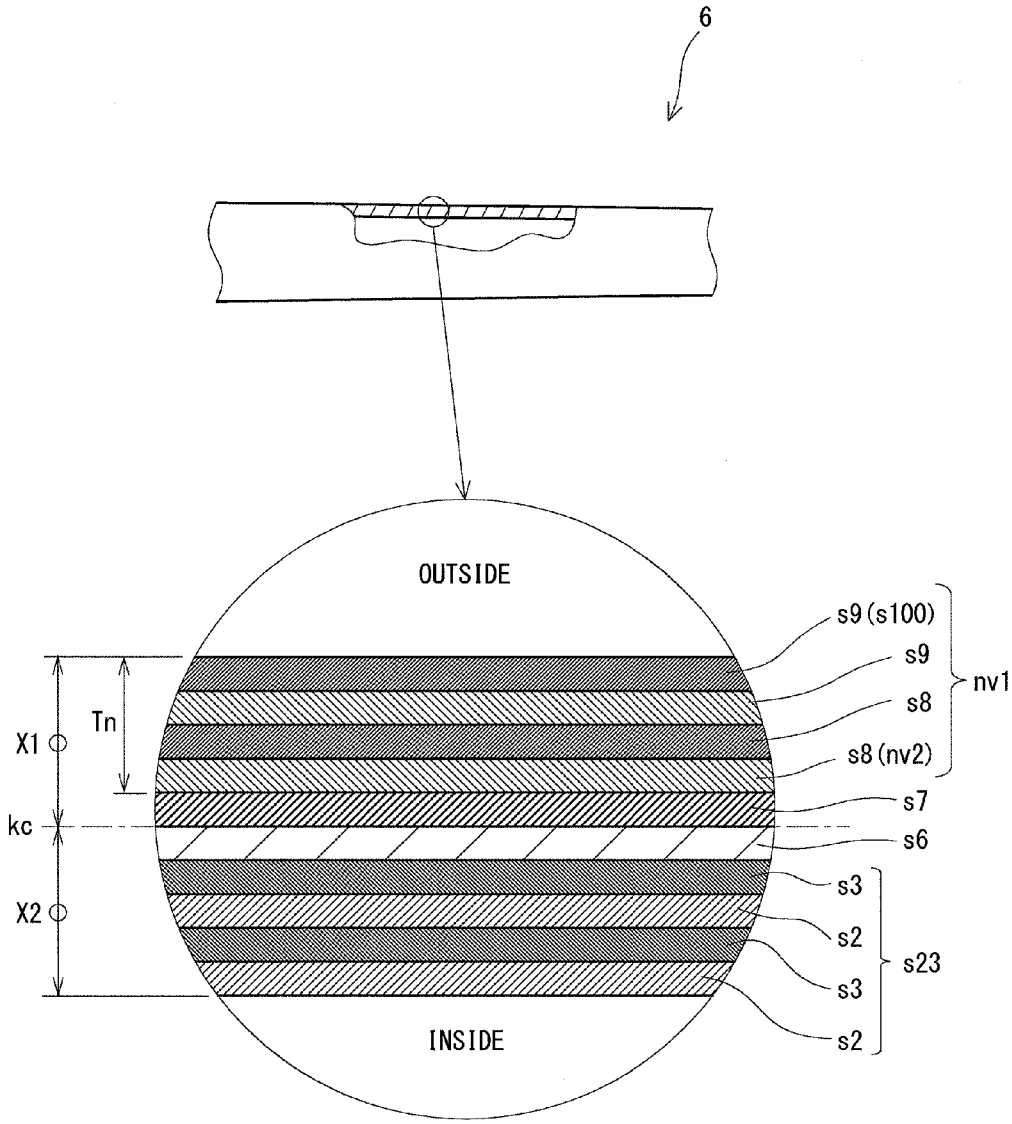
FIG. 5 is an enlarged cross-sectional view of the shaft of FIG. 1.

The enlarged view of the cross-section of the shaft 6 is shown in a circle of FIG. 5. FIG. 5 is a cross-sectional view at the central position in the longitudinal direction of the shaft 6. A portion in which only the full length sheet exists is shown in FIG. 5.

In the shaft 6, the bias sheet s2 is set to be two plies, and the bias sheet s3 is also set to be two plies. Therefore, four bias layers in total are formed.

In the shaft 6, the full length straight sheet s6 is set to be one ply. Therefore, one full length straight layer s6 is formed.

In the shaft 6, the full length hoop sheet s7 is set to be one ply. Therefore, one full length hoop layer s7 is formed.

In the shaft 6, the full length straight sheet s8 is set to be two plies. Therefore, two full length straight layers s8 are formed.

In the shaft 6, the full length straight sheet s9 is set to be two plies. Therefore, two full length straight layers s9 are formed. The outside one of the two full length straight layers s9 is an outermost full length straight layer s100.

The shaft 6 includes a novolac-containing layer. The novolac-containing layer includes a matrix resin including a novolac type epoxy resin.

In the shaft 6, the sheet s8, the sheet s9, the sheet s10, and the sheet s11 are the novolac-containing layers. All the straight layers located outside the hoop layer s7 are the novolac-containing layers.

In the shaft 6, the full length straight layers s8 and s9 located outside the full length bias layers s2 and s3 are the novolac-containing layers. The strength of the shaft is effectively increased by the full length straight layers s8 and s9 located outside.

In the shaft 6, the partial straight layers s10 and s11 located outside the full length straight layers s8 and s9 which are the novolac-containing layers are the novolac-containing layers. The partial straight layers s10 and s11 which are located outside and reinforce a tip part are the novolac-containing layers, and thereby the strength of the tip part of the shaft is effectively increased. In the shaft 6, the partial straight layer s11 which is located on the outermost side and reinforces the tip part is the novolac-containing layer. Therefore, the strength of the tip part of the shaft is increased.

In the novolac-containing layers s8, s9, s10, and s11, the content Rn of the novolac type epoxy resin in the matrix resin is 3% by mass or greater and 19% by mass or less. It was found that the content Rn in the numerical value range contributes to the improvement in the shaft strength.

In the present application, the average specific gravity of the novolac-containing layers constituting the full length straight layers is defined as S1, and the average specific gravity of the full length bias layers and inside of the full length bias layers is defined as S2. Layers to be a target of the specific gravity S2 are the full length bias layers and the layer (s) located inside the full length bias layers, whether the layer (s) is/are the novolac-containing layer (s) is no object. In the shaft 6, the specific gravity S1 is greater than the specific gravity S2. In the shaft 6, the novolac-containing layers constituting the full length straight layers are four layers in all: the layers s8 (two layers) and the layers s9 (two layers) (see FIG. 5). If there is no layer inside the full length bias layers, the specific gravity S2 is a specific gravity of the full length bias layers.

If the fiber is increased and the matrix resin is decreased, the specific gravity of the layer is increased. Since the resin is decreased in this case, adhesiveness between the layers is apt to be reduced. Delamination may decrease the strength of the shaft. However, the layer having a large specific gravity contains the novolac type epoxy resin, and thereby the decrease in the shaft strength in the high-density layer is suppressed. The novolac-containing layer having a high fiber content is disposed outside, and thereby a strength improving effect A and a strength improving effect B can be synergistically exhibited. The strength improving effect A is a strength improving effect caused by the novolac type epoxy resin, and the strength improving effect B is a strength improving effect caused by an increase in a fiber amount. Flexural fracture often occurs from the outside of the shaft. The strength improving effect A and the strength improving effect B are increased by the outside disposal of the novolac-containing layer having a high fiber content.

The specific gravity S1 is greater than the specific gravity S2, and thereby the prepreg having a low specific gravity can be disposed inside. Therefore, the weight saving of the inside layer of the shaft is achieved, and the weight saving of the shaft weight is also achieved. Meanwhile, since the specific gravity S1 is large, the fiber content of the layer comparatively located outside can be increased. Therefore, the shaft strength is improved. Furthermore, since the layer having a high specific gravity S1 is a novolac-containing layer nv1, the strength improving effect due to the fiber content and the strength improving effect due to a novolac resin are synergistically exhibited.

The novolac-containing layer nv1 having a high specific gravity S1 is disposed outside, and thereby the moment of inertia of the shaft around the shaft axis line is increased. The improvement in the moment of inertia can contribute to the directional stability of a hit ball. The novolac-containing layer nv1 having a high specific gravity S1 is disposed outside, and thereby the specific gravity of the outside of the shaft is higher than that of the inside of the shaft. Therefore, the vibration damping performance of the shaft can be improved. The improvement in the vibration damping performance can improve ball hitting feeling. In these respects, a specific gravity Sx1 of an outside region X1 of the shaft is preferably greater than a specific gravity Sx2 of an inside region X2 of the shaft. The outside region X1 of the shaft means a region located outside a boundary surface kc dividing the thickness of the shaft into two equal parts (see FIG. 5). The inside region X2 of the shaft is a region located inside the boundary surface kc dividing the thickness of the shaft into two equal parts (see FIG. 5).

The total thickness of the novolac-containing layers nv1 located in the outermost part of the shaft is shown by a double pointed arrow Tn in FIG. 5. The thickness Tn is defined in a portion in which only the full length layer exists. In respect of the shaft strength, the thickness Tn is preferably equal to or greater than 0.1 mm, more preferably equal to or greater than 0.2 mm, and still more preferably equal to or greater than 0.3 mm. In respect of the weight saving, the thickness Tn is preferably equal to or less than 0.8 mm, more preferably equal to or less than 0.7 mm, and still more preferably equal to or less than 0.6 mm.

The shaft 6 has the outermost full length straight layer s100. The outermost full length straight layer s100 is the novolac-containing layer. The strength of the shaft 6 is effectively increased by the constitution. The outermost full length straight layer s100 is a straight layer located on the outermost side among the full length layers.

In the shaft 6, N layers located on the outermost side among the full length straight layers are the novolac-containing layers nv1. In the shaft 6, the layers s8 and s9 among the full length straight layers are the novolac-containing layers nv1. For this reason, in the shaft 6, four layers located on the outermost side among the full length straight layers are the novolac-containing layers nv1 (see FIG. 5). That is, in the shaft 6, the N is 4. The strength of the shaft 6 is effectively increased by the constitution. In respect of the shaft strength, the N is preferably equal to or greater than 2, more preferably equal to or greater than 3, and still more preferably equal to or greater than 4. In respect of the weight saving of the shaft, the N is preferably equal to or less than 8, more preferably equal to or less than 7, and still more preferably equal to or less than 6.

In the shaft 6, all the novolac-containing layers nv1 are the straight layers. The straight layer largely contributes the flexural strength of the shaft. All the novolac-containing layers nv1 are the straight layers, and thereby the shaft strength is effectively increased.

In the shaft 6, the M full length straight layers which are the novolac-containing layers nv1 are provided. In the shaft 6, the M is 4. As shown in FIG. 5, in the shaft 6, all the M layers are located on the outermost side among the full length layers. The shaft strength is effectively increased by the constitution. In respect of the shaft strength, the M is preferably equal to or greater than 2, more preferably equal to or greater than 3, and still more preferably equal to or greater than 4. In respect of the weight saving of the shaft, the M is preferably equal to or less than A, more preferably equal to or less than 7, and still more preferably equal to or less than 6.

In the shaft 6, the fiber elastic modulus Y1 of the novolac-containing layer nv1 is equal to or greater than 8 t/mm$^2$ and less than 38 t/mm$^2$. In the shaft 6, the fiber elastic modulus Y10 of the novolac-containing layer nv1 located outside the full length bias layer is equal to or greater than 8 t/mm$^2$ and less than 38 t/mm$^2$. In the shaft 6, the fiber elastic modulus Y2 of the full length straight layer other than the novolac-containing layer is 38 t/mm$^2$ or greater and 70 t/mm$^2$ or less. In the shaft 6, the fiber elastic modulus Y3 of the full length bias layer is 38 t/mm$^2$ or greater and 70 t/mm$^2$ or less.

The fiber elastic modulus Y1 is set to be equal to or greater than 8 t/mm$^2$ and less than 38 t/mm$^2$, and thereby the shaft strength is effectively increased. The shaft strength is effectively increased by the combination of the fiber having a comparatively high strength with the novolac type epoxy resin. Since the novolac-containing layer nv1 is disposed comparatively outside, the shaft strength is further increased. More preferably, the fiber elastic modulus Y1 is 8 t/mm$^2$ or greater and 30 t/mm$^2$ or less.

The fiber elastic modulus Y10 is set to be equal to or greater than 8 t/mm$^2$ and less than 38 t/mm$^2$, and thereby the shaft strength is effectively increased. The shaft strength is effectively increased by the combination of the fiber having a comparatively high strength with the novolac type epoxy resin. Since the novolac-containing layer nv1 is disposed comparatively outside, the shaft strength is further increased. More preferably, the fiber elastic modulus Y10 is 8 t/mm$^2$ or greater and 30 t/mm$^2$ or less.

The fiber elastic modulus Y2 is set to be 38 t/mm$^2$ or greater and 70 t/mm$^2$ or loss, and thereby the flexural rigidity can be increased while the fiber amount is reduced. Therefore, the weight saving can be attained while the required flex is secured.

The fiber elastic modulus Y3 is set to be 38 t/mm$^2$ or greater and 70 t/mm$^2$ or less, and thereby the torsional rigidity can be increased while the fiber amount is reduced. Therefore, the weight saving can be attained while the required torque is secured.

As shown in FIG. 5, the full length novolac-containing layer nv1 located on the innermost side is defined as an innermost novolac-containing layer nv2. In the shaft 6, the fiber elastic modulus Y4 of the full length layer located inside the innermost novolac-containing layer nv2 is 38 t/mm$^2$ or greater and 70 t/mm$^2$ or less. The rigidity can be increased while the fiber amount is reduced by the constitution. Therefore, the weight saving can be attained while the required torque and/or flex are/is secured. A highly-elastic layer having a comparatively low strength is disposed inside, and thereby the shaft strength can be increased. The full length novolac-containing layer is the novolac-containing layer of the full length layer.

In the shaft 6, the fiber elastic modulus Y5 of the full length bias layer and the layer located inside the full length bias layer is 38 t/mm$^2$ or greater and 70 t/mm$^2$ or less. The rigidity can be increased while the fiber amount is reduced by the constitution. Therefore, the weight saving can be attained while the required torque and/or flex are/is secured. A highly-elastic layer having a comparatively low strength is disposed inside, and thereby the shaft strength can be increased.

[Matrix Resin]

An epoxy resin composition is preferable as the matrix resin. The epoxy resin composition preferably contains an epoxy resin having two epoxy groups in a molecule as an epoxy resin component, i.e., a bifunctional epoxy resin. Specific examples of the bifunctional epoxy resin include bisphenol type epoxy resins such as a bisphenol A type epoxy resin and a hydrogen additive thereof, a bisphenol F type epoxy resin and a hydrogen additive thereof, a bisphenol S type epoxy resin, a tetrabromobisphenol A type epoxy resin, and a bisphenol AD type epoxy resin. The bisphenol type epoxy resins may be used alone or in the form of a mixture of two or more.

If the bisphenol type epoxy resin is used, the bisphenol A type epoxy resin and the bisphenol F type epoxy resin are preferably used in combination. The flexural strength of the shaft can be improved by the combination use. The content ratio of the bisphenol A type epoxy resin and the bisphenol F type epoxy resin is preferably 20:80 to 80:20 in amass ratio, more preferably 30:70 to 70:30, and still more preferably 40:60 to 60:40.

The epoxy equivalent (g/eq) of the bisphenol type epoxy resin is preferably equal to or greater than 200, and more preferably equal to or greater than 250. The epoxy equivalent (g/eq) of the bisphenol type epoxy resin is preferably equal to or less than 400, and more preferably equal to or less than 350. If the epoxy equivalent of the bisphenol type epoxy resin is less than 200, the epoxy resin component may become a liquid state at room temperature, which may make it difficult to produce the prepreg and mold the prepreg. If the epoxy equivalent is greater than 400, the epoxy resin component may become a solid state at room temperature, which may make it difficult to mold the bisphenol type epoxy resin.

Examples of the bisphenol A type epoxy resin include jER827, jER828, jER1001, jER1002, jER1003, jER1003F, jER1004, jER1004FS, jER1004E, jER1004AF, jER1055, jER1005F, jER1006FS, jER1007, jER1007FS, jER1008, and jER1009 manufactured by Mitsubishi Chemical Corporation. The "jER" is a registered trademark.

Other examples of the bisphenol A type epoxy resin include EPOTOHTO YD-011, EPOTOHTO YD-012, EPOTOHTO YD-013, EPOTOHTO YD-014, EPOTOHTO YD-017, EPOTOHTO YD-019, EPOTOHTO YD-020N, and EPOTOHTO YD-020H manufactured by Tohto Kasei Co., Ltd. The "EPOTOHTO" is a registered trademark.

Other examples of the bisphenol A type epoxy resin include EPICLON 1050, EPICLON 3050, EPICLON 4050, and EPICLON 7050 manufactured by DIC Corporation. The "EPICLON" is a registered trademark. Other examples of the bisphenol A type epoxy resin include EP-5100, EP-5400, EP-5700, and EP-5900 (manufactured byAdeka Corporation), and DER-661, DER-663U, DER-664, DER-667, DER-668, and DER-669 (manufactured by The Dow Chemical Company).

Examples of the bisphenol F type epoxy resin include jER806, jER807, jER4005P, jER4007P, and jER4010P (manufactured by Mitsubishi Chemical Corporation).

It is preferable That the epoxy resin composition further contains a polyfunctional epoxy resin having three or more epoxy groups in a molecule in addition to the epoxy resin having two epoxy groups in a molecule. The epoxy resin composition contains the polyfunctional epoxy resin, and thereby the crosslinking density of a cured product of the epoxy resin composition can be controlled. The crosslinking density is controlled to set the elongation of the cured product of the epoxy resin composition to a moderate range, and thereby an interfacial strength between a reinforced fiber and the epoxy resin is considered to be improved.

Examples of the polyfunctional epoxy resin include, but are not particularly limited to, novolac type epoxy resins such as a phenol novolac type epoxy resin and an o-cresol novolac type epoxy resin; glycidyl ether epoxy resins such as a triglycidyl ether of tris(p-hydroxyphenyl)methane and a derivative thereof, a tetraglycidyl ether of tetrakis(p-hydroxyphenyl)ethane and a derivative thereof, a triglycidyl ether of glycerin, and a tetraglycidyl ether of pentaerythritol; and glycidyl amine epoxy resins such as tetraglycidyldiaminodiphenylmethane, tetraglycidyl-m-xylylenediamine, and triglycidyl-m-aminophenol.

The polyfunctional epoxy resin is preferably the novolac type epoxy resin. Examples of the novolac type epoxy resin include a phenol novolac type epoxy resin and an o-cresol novolac type epoxy resin. In respect of the strength of the resin cured product, the content ratio Rn of the novolac type epoxy resin in the epoxy resin component is preferably equal to or greater than 3% by mass, more preferably equal to or greater than 4% by mass, still more preferably equal to or greater than 5% by mass, and yet still more preferably equal to or greater than 7% by mass. The content ratio Rn is preferably equal to or less than 19% by mass, more preferably equal to or less than 14% by mass, still more preferably equal to or less than 13% by mass, and yet still more preferably equal to or less than 11% by mass.

The epoxy equivalent (g/eq) of the polyfunctional epoxy resin is preferably equal to or greater than 50, more preferably equal to or greater than 75, and still more preferably equal to or greater than 100. The epoxy equivalent (g/eq) of the polyfunctional epoxy resin is preferably equal to or less than 500, more preferably equal to or less than 400, and still more preferably equal to or less than 300. If the epoxy equivalent of the polyfunctional epoxy resin is within the range, a crosslinking structure can be effectively formed.

Examples of the commercial item of the phenol novolac type epoxy resin include jER152 and jER154 (manufactured by Mitsubishi Chemical Corporation), EPICLON N-740, EPICLON N-770, and EPICLON N-775 (manufactured by DIC Corporation), PY307, EPN1179, and EPN1180 (manufactured by Huntsman Advanced Materials Gmbh), YDPN638, and YDPN638P (manufactured by Tohto Kasei Co., Ltd.), DEN431, DEN438, and DEN439 (manufactured by The Dow Chemical Company), EPR600 (manufactured by Bakelire AG), and EPPN-201 (manufactured by Nippon Kayaku Co., Ltd.).

The epoxy resin composition preferably contains a curing agent. As the curing agent, there can be used a dicyandiamide; aromatic amines having active hydrogen such as 4,4'-diaminodiphenylmethane, 4,4'-diaminodiphenylsulfone, 3,3'-diaminodiphenylsulfone, m-phenylenediamine, and m-xylylenediamine; aliphatic amines having active hydrogen such as diethylenetriamine, triethylenetetramine, isophoronediamine, bis(aminomethyl)norbornane, bis(4-aminocyclohexy)methane, and a dimer acid ester of polyethyleneimine; modified amines obtained by reacting the amines having active hydrogen with compounds such as an epoxy compound, acrylonitrile, phenol and formaldehyde, and thiourea; tertiary amines having no active hydrogen such as dimethylaniline, triethylenediamine, dimethylbenzylamine, and 2,4,6-tris (dimethylaminomethyl) phenol; imidazoles such as 2-methylimidazole and 2-ethyl-4-methylimidazole; polyamide resins; carboxylic anhydrides such as hexahydrophthalic anhydride, tetrahydrophthalic anhydride, methyl hexahydrophthalic anhydride, and methylnadic anhydride; polycarboxylic acid hydrazides such as a adipic acid hydrazide and a naphthalene dicarboxylic acid dihydrazide; polyphenol compounds such as a novolac resin; polymercaptans such as an ester of thioglycolic acid and polyol; and Lewis acid complexes such as a boron trifluoride ethylamine complex, or the like. Among them, the dicyandiamide is preferably used as the curing agent.

The added amount of the dicyandiamide is preferably equal to or greater than 13 g per 1 mol of the epoxy group of the epoxy resin component, more preferably equal to or greater than 15 g, and still more preferably equal to or greater than 17 g. The added amount of the dicyandiamide per 1 mol of the epoxy group of the epoxy resin component is preferably equal to or less than 40 g, more preferably equal to or less than 38 g, and still more preferably equal to or less than 35 g. If the added amount of the dicyandiamide is within the range, the mechanical properties of the cured product of the epoxy resin composition are improved.

A suitable curing auxiliary agent can be combined with the curing agent in order to increase curing activity. A urea derivative in which ac least one of hydrogens bonded to urea is substituted with a hydrocarbon group is preferable as the curing auxiliary agent. The hydrocarbon group may be further substituted with, for example, a halogen atom, a nitro group, and an alkoxy group or the like. Examples of the urea derivative include derivatives of monourea compounds such as 3-phenyl-1 μl-dimethyl urea, 3-(parachlorophenyl)-1,1-dimethyl urea, 3-(3,4-dichlorophenyl)-1,1-dimethyl urea, 3-(orthomethylphenyl)-1,1-dimethyl urea, 3-(paramethylphenyl)-1,1-dimethyl urea, 3-(methoxyphenyl)-1,1-dimethyl urea, 3-(nitrophenyl)-1,1-dimethyl urea; and derivatives of bisurea compounds such as N,N-phenylene-bis(N'-N'-dimethyl urea) and N,N-(4-methyl-1,3-phenylene)-bis (N',N'-dimethyl urea). Preferred examples of the combination of the curing agent and the curing auxiliary agent include a combination of dicyandiamide with one of urea derivatives such as 3-phenyl-1,1-dimethyl urea, 3-(3,4-dichlorophenyl)-1,1-dimethyl urea (DCMU), 3-(3-chloro-4-methylphenyl)-1,1-dimethyl urea, and 2,4-bis(3,3-dimethylureide)toluene as the curing auxiliary agent. Among them, the dicyandiamide is more preferably combined with 3-(3,4-dichlorophenyl) 1-dimethyl urea (DCMU) as the curing auxiliary agent.

It is preferable that the dicyandiamide (DICY) is used as the curing agent and the urea derivative is used as the curing auxiliary agent. In this case, the content ratio of the dicyandiamide (DICY) and the urea derivative is preferably equal to or greater than 1 in amass ratio (DICY/urea derivative), more preferably equal to or greater than 1.2, and still more preferably equal to or greater than 1.5. The content ratio is preferably equal to or less than 3, more preferably equal to or less than 2.8, and still more preferably equal to or less than 2.5. The mass ratio (DICY/urea derivative) is most preferably 2. If the mass ratio of DICY/urea derivative is within the range, a curing rate is fast, and the cured product has good physical properties.

The epoxy resin composition may further contain other components such as an oligomer, a polymer compound, and organic or inorganic particles.

Examples of the oligomer capable of being blended with the epoxy resin composition used in the present invention include polyester polyurethane having a polyester skeleton and a polyurethane skeleton, an urethane(meth)acrylate having a polyester skeleton and a polyurethane skeleton and further having a (meth)acrylate group at a molecular chain terminal, and an indene-based oligomer.

A thermoplastic resin is suitably used as the polymer compound capable of being blended with the epoxy resin composition. The thermoplastic resin is preferably blended because the viscosity control of the resin, the handleability control of the prepreg sheet, or the effect of an adhesive improvement is increased.

Examples of the thermoplastic resin include polyvinyl acetal resins such as polyvinyl formal and polyvinyl butyral, polyvinyl alcohol, and a phenoxy resin. The thermoplastic resin may have an amide bond or a sulfonyl group. Examples of the thermoplastic resin having an amide bond include polyamide and polyimide. Examples of the thermoplastic resin having a sulfonyl group include polysulfone. The polyamide, the polyimide, and the polysulfone may have functional groups such as an ether bond and a carbonyl group in a main chain. The polyimide may have a substituent on a nitrogen atom of an amide group. The epoxy resin composition used in the present invention preferably contains polyvinyl formal as the thermoplastic resin.

The content ratio of the thermoplastic resin is preferably equal to or greater than 2 parts by mass per 100 parts by mass of the epoxy resin component, more preferably equal to or greater than 3 parts by mass, and still more preferably equal to or greater than 4 parts by mass. The content ratio of the thermoplastic resin per 100 parts by mass of the epoxy resin component is preferably equal to or less than 12 parts by mass, and more preferably equal to or less than 8 parts by mass. If the content ratio of the thermoplastic resin is equal to or greater than 2 parts by mass, the elongation of the epoxy resin composition is improved, which can apply tackiness. Meanwhile, if the content ratio of the thermoplastic resin is greater than 12 parts by mass, the epoxy resin composition is possibly solidified at room temperature. Therefore, the impregnability of the epoxy resin composition to the reinforced fiber is reduced, which may cause voids at the production of the prepreg.

Rubber particles and thermoplastic resin particles can be used as the organic particles capable of being blended with the epoxy resin composition. These particles have effects of improving the toughness of the resin and the impact resistance of a fiber-reinforced composite material. Crosslinking rubber particles, and core shell rubber particles obtained by the graft-polymerization of different polymers to the surfaces of the crosslinking rubber particles are preferably used as the rubber particles.

XER-91 (manufactured by Japan Synthetic Rubber Co., Ltd.) made of a crosslinked product of a carboxyl-modified butadiene-acrylonitrile copolymer, CX-MN series (manufactured by Nippon Shokubai Co., Ltd.) made of acrylic rubber fine particles, and YR-500 series (manufactured by Tohto Kasei Co., Ltd.), or the like can be used as commercially available crosslinking rubber particles. Paraloid EXL-2655 (manufactured by Kureha Chemical Industry Co., Ltd.) made of a butadiene-alkyl methacrylate-styrene copolymer, STAPHYLOID AC-3355 and TR-2122 (manufactured by Takeda Chemical Industries, Ltd.) made of an acrylicester-methacrylic acid ester copolymer, and PARALOIDEXL-2611 and EXL-3387 (registered trademarks, brand names, manufactured by Rohm & Haas Company) made of a butyl acrylate-methyl methacrylate copolymer, or the like can be used as commercially available core shell rubber particles.

Polyamide or polyimide particles are preferably used as the thermoplastic resin particles. "SP-500" (brand name) manufactured by Toray Industries, Inc. and "Orgasole" (registered trademark) manufactured by ATOCHEM, or the like can be used as commercially available polyamide particles.

Silica, alumina, smectite, and synthetic mica or the like can be blended as the inorganic particles capable of being blended with the epoxy resin composition. These inorganic particles are blended to mainly control rheology, i.e., to apply viscosity and thixotropy.

The tensile strength (breaking strength) of the cured product of the epoxy resin composition is preferably equal to or greater than 20 MPa, more preferably equal to or greater than 30 MPa, and still more preferably equal to or greater than 50 MPa. The tensile strength is preferably equal to or less than 500 MPa, more preferably equal to or less than 450 MPa, and still more preferably equal to or less than 400 MPa. The elongation (rupture elongation) of the cured product of the epoxy resin composition is preferably equal to or greater than 2%, and more preferably equal to or greater than 3%. The elongation (rupture elongation) is preferably equal to or less than 300%, and more preferably equal to or less than 100%. Methods for measuring the tensile strength and the elongation will be described later.

Although the resin component of the matrix resin preferably includes only the epoxy resin composition, a commercially available epoxy resin composition may be used in combination within a range in which the effect of the present invention will not be obstructed. If the commercially available epoxy resin composition is used in combination, the content of the commercially available epoxy resin composition in the resin component of the matrix resin is preferably equal to or less than 95% by mass, more preferably equal to or less than 90% by mass, and still more preferably equal to or less than 80% by mass.

The swelling ratio of the cured product of the epoxy resin composition in methyl ethyl ketone is preferably equal to or greater than 20% by mass, and more preferably equal to or greater than 25% by mass. The swelling ratio is preferably equal to or less than 42.5% by mass, and more preferably equal to or less than 38% by mass. The swelling ratio in the methyl ethyl ketone indexes the crosslinking degree of the cured product of the epoxy resin composition. If the swelling ratio is 20% by mass to 42.5% by mass, a more suitable crosslinking density can be obtained. A moderate elongation for improving the interfacial strength can be obtained by the crosslinking density.

Examples of the reinforced fiber include a carbon fiber, a glass fiber, an aramid fiber, a boron fiber, an alumina fiber, and a silicon carbide fiber. Two or more of the fibers can also be mixed. The reinforced fiber is preferably the carbon fiber.

Examples of the carbon fiber include a PAN-based, pitch-based, and rayon-based carbon fibers. In respect of the tensile strength, the PAN-based carbon fiber is preferable. A carbon fiber (a so-called twisted yarn) obtained by twisting a precursor fiber and firing the twisted precursor fiber, a carbon fiber (a so-called untwisted yarn) obtained by untwisting the twisted yarn, and a twist-less yarn obtained by heat-treating the precursor fiber without substantially twisting the precursor fiber can be used as the carbon fiber. In light of the balance between the formability and strength property of the fiber-reinforced composite material, the twist-less yarn or the untwisted yarn is preferable. Furthermore, in respect of handleability such as the adhesiveness between the prepreg sheets, the twist-less yarn is preferable. The carbon fiber can also contain a graphite fiber.

The tensile elastic modulus of the reinforced fiber is preferably equal to or greater than 10 t/mm$^2$, and more preferably equal to or greater than 24 t/mm$^2$. The tensile elastic modulus is preferably equal to or less than 70 t/mm$^2$, and more preferably equal to or less than 50 t/mm$^2$. The tensile elastic modulus is measured based on JIS R 7601: 1986 "Testing Method for Carbon Fibers". If the tensile elastic modulus of the reinforced fiber is within the range, the flexural strength can be improved.

The content of the reinforced fiber in the shaft is preferably equal to or greater than 65% by mass, and more preferably equal to or greater than 70% by mass. The content of the reinforced fiber in the shaft is preferably equal to or less than 80% by mass, and more preferably equal to or less than 75% by mass. If the content of the reinforced fiber is within the range, a good fiber-reinforced epoxy resin material capable of sufficiently utilizing the high strength of the resin can be provided.

A known method is used to manufacture the shaft. Examples thereof include a method for producing a prepreg obtained by impregnating a reinforced fiber such as a carbon fiber with the epoxy resin composition, cutting the prepreg into the shapes of materials constituting the shaft, stacking the prepregs to obtain a laminate, and applying a pressure to the laminate while heating the laminate. Specific example of the method is as described above as the manufacturing method of the shaft 6.

The prepreg can be manufactured by a wet method and a hot melt method or the like. In the wet method, the reinforced fiber is impregnated with the epoxy resin composition dissolved in a solvent such as methyl ethyl ketone or methanol to reduce the viscosity of the epoxy resin composition. In the hot melt method, the reinforced fiber is impregnated with the epoxy resin composition having a viscosity reduced by heating.

In the wet method, after a reinforced fiber is immersed in a solution containing an epoxy resin composition, the reinforced fiber is pulled up, and the solvent is evaporated while the reinforced fiber is heated using an oven or the like, to obtain a prepreg. The hot melt method includes two methods. The first method directly impregnates a reinforced fiber with an epoxy resin composition having a viscosity reduced by heating. The second method once produces films obtained by coating a mold release paper or the like with an epoxy resin composition, and then overlaps the film(s) from both the sides or one side of a reinforced fiber and heats the film(s) to impregnate the fiber with the epoxy resin composition, thereby making a prepreg. The hot melt method is preferable because a solvent does not substantially remain in a prepreg.

Examples of the method for applying a pressure to the laminate of the prepreg while heating the laminate include a wrapping tape method and an internal pressure molding method. The wrapping tape method winds a prepreg around a core bar such as a mandrel to obtain a molded body. Specifically, the wrapping tape method winds a prepreg around a mandrel, winds a wrapping tape made of a thermoplastic resin film on the outside of the prepreg in order to fix the prepreg and apply a pressure, cures a resin by heating in an oven, and then extracts a core bar to obtain a tubular molded body. The surface of the tubular molded body may be ground, and the ground surface may be coated.

The internal pressure molding method winds a prepreg around an internal pressure applying body such as a tube made of a thermoplastic resin to make a preform, then sets the preform in a mold, and then heating the mold while introducing a high-pressure gas into the internal pressure applying body to apply a pressure, thereby performing molding.

Examples of the form of the reinforced fiber in the prepreg include a continuous fiber aligned in one direction, a bidirectional fabric, a multiaxial fabric, a nonwoven fabric, a mat, a knit, and a braid. Herein, the continuous fiber means a single fiber or a fiber bundle substantially continuous over a length of equal to or greater than 10 mm. In a so-called unidirectional prepreg using continuous fibers aligned in one direction, the directions of the fibers are aligned, and the fiber bending is reduced. Thereby, the strength utilization rate in the fiber direction is high. In the unidirectional prepreg (UD prepreg), a plurality of prepregs can be appropriately stacked so that the alignment directions of the reinforced fibers are different. This facilitates the designs of an elastic modulus and strength in each direction.

EXAMPLES

Hereinafter, the effects of the present invention will be clarified by examples. However, the present invention should not be interpreted in a limited way based on the description of the examples.

[Carbon Fiber]

Carbon fibers were used as materials for producing prepregs. The specifications of the carbon fibers are shown in the following Table 1.

TABLE 1

Specifications of carbon fibers

| Part number | Manufacturer | Tensile elastic modulus (t/mm$^2$) | Tensile strength (t/mm$^2$) | Density (g/cm$^3$) |
|---|---|---|---|---|
| XN-10 | Nippon Graphite Fiber Corporation | 10 | 0.17 | 1.7 |
| XN-15 | Nippon Graphite Fiber Corporation | 15 | 0.24 | 1.85 |

TABLE 1-continued

| Specifications of carbon fibers | | | | |
|---|---|---|---|---|
| Part number | Manufacturer | Tensile elastic modulus ($t/mm^2$) | Tensile strength ($t/mm^2$) | Density ($g/cm^3$) |
| T700SC | Toray Industries, Inc. | 24 | 0.5 | 1.8 |
| T800SC | Toray Industries, Inc. | 30 | 0.6 | 1.8 |
| M40JB | Toray Industries, Inc. | 40 | 0.45 | 1.75 |
| M50JB | Toray Industries, Inc. | 50 | 0.42 | 1.88 |
| YSH-60A | Nippon Graphite Fiber Corporation | 63 | 0.39 | 2.12 |
| YS-80A | Nippon Graphite Fiber Corporation | 80 | 0.36 | 2.17 |

[Matrix Resin]

Matrix resins were produced as the materials for producing the prepregs. Raw materials were blended as in the following Table 2 to obtain eight matrix resin compositions R1 to R8. The blendings and specifications of the matrix resins are shown in the following Table 2.

TABLE 2

| Specifications of matrix resin compositions | | | | | | | | | |
|---|---|---|---|---|---|---|---|---|---|
| Matrix resin composition | | R1 | R2 | R3 | R4 | R5 | R6 | R7 | R8 |
| Blending | jER828EL (Epoxy equivalent 190) | 40 | 40 | 40 | 40 | 40 | 40 | 40 | 40 |
| | jER4005P (Epoxy equivalent 1070) | 41 | 41 | 41 | 41 | 41 | 41 | 41 | 41 |
| | jER154 (Epoxy equivalent 180) | 0 | 2 | 4 | 7 | 10 | 13 | 18 | 20 |
| | Polyvinyl formal | 4 | 4 | 4 | 4 | 4 | 4 | 4 | 4 |
| | Dicyandiamide | 4.5 | 4.7 | 4.9 | 5.2 | 5.5 | 5.8 | 6.3 | 6.5 |
| | Urea derivative | 2.3 | 2.4 | 2.5 | 2.6 | 2.8 | 2.9 | 3.2 | 3.3 |
| Polyvinyl formal (ppH) | | 4.9 | 4.9 | 4.9 | 4.9 | 4.9 | 4.9 | 4.9 | 4.9 |
| Content of dicyandiamide (g/epoxy 1 mol) | | 18.1 | 18.1 | 18.1 | 18.1 | 18.1 | 18.1 | 18.1 | 18.1 |
| Total content of epoxy resin | | 81 | 83 | 85 | 88 | 91 | 94 | 99 | 101 |
| Ratio of bisphenol A type and bisphenol F type (A type/F type) | | 0.98 | 0.93 | 0.98 | 0.98 | 0.98 | 0.98 | 0.98 | 0.98 |
| Rn (% by mass) | | 0.0 | 2.4 | 4.7 | 8.0 | 11.0 | 13.8 | 18.2 | 19.8 |
| Total epoxy equivalent of bisphenol type | | 326 | 326 | 326 | 326 | 326 | 326 | 326 | 326 |
| Epoxy equivalent of whole of epoxy resin | | 326 | 319 | 314 | 306 | 299 | 294 | 284 | 281 |
| MEK swelling rate (% by mass) | | 45.6 | 42.5 | 37.1 | 32.5 | 27.3 | 23.6 | 19.6 | 13.2 |
| Epoxy resin composition, tensile strength (Mpa · %) | | 70 | 92 | 110 | 117 | 116 | 103 | 86 | 68 |
| Fiber-reinforced epoxy resin material, tensile strength (MPa) | | 27 | 40 | 50 | 55 | 56 | 49 | 40 | 22 |

Note 1)
The unit of blending is part by mass.
Note 2)
ppH means part by mass per 100 parts by mass of an epoxy resin.

[Production of Prepreg]

Prepregs were produced using the carbon fibers and the matrix resin compositions. Each of the matrix resin compositions was dissolved in methyl ethyl ketone to produce an MEK solution of an epoxy resin. The MEK content of the MEK solution was 30% by mass. Into the obtained MEK solution, a curing agent and a curing auxiliary agent were added, and the resultant solution was stirred to prepare an epoxy resin composition solution. The epoxy resin composition solution was applied to a mold release paper, and dried to obtain an epoxy resin composition sheet. The sheet made of the carbon fiber was impregnated with the epoxy resin composition sheet by using a hot melt method to obtain prepregs P1 to P12. The specifications of the prepregs are shown in the following Tables 3 and 4.

TABLE 3

| Specifications of prepregs | | | | | | |
|---|---|---|---|---|---|---|
| Prepreg | P1 | P2 | P3 | P4 | P5 | P6 |
| Matrix resin composition | R7 | R6 | R4 | R3 | R2 | R7 |
| Ratio of novolac type epoxy resin to whole of epoxy resin (% by mass) | 18.2 | 13.8 | 8.0 | 4.7 | 2.4 | 18.2 |
| Carbon fiber | T800SC | T800SC | T800SC | T800SC | T800SC | M40JB |
| Fiber elastic modulus (t/mm$^2$) | 30 | 30 | 30 | 30 | 30 | 40 |
| Thickness of prepreg (mm) | 0.09 | 0.09 | 0.09 | 0.09 | 0.09 | 0.09 |
| Specific gravity of prepreg (g/cm$^2$) | 1.59 | 1.59 | 1.59 | 1.59 | 1.59 | 1.48 |
| Resin content of prepreg (% by mass) | 30 | 30 | 30 | 30 | 30 | 45 |

TABLE 4

| Specifications of prepregs | | | | | | |
|---|---|---|---|---|---|---|
| Prepreg | P7 | P8 | P9 | P10 | P11 | P12 |
| Matrix resin composition | R4 | R4 | R4 | R4 | R4 | R4 |
| Ratio of novolac type epoxy resin to whole of epoxy resin (% by mass) | 8.0 | 8.0 | 8.0 | 8.0 | 8.0 | 8.0 |
| Carbon fiber | M40JB | XN-15 | T700SC | M50JB | YSH-60A | YS-80A |
| Fiber elastic modulus (t/mm$^2$) | 40 | 15 | 24 | 50 | 60 | 80 |
| Thickness of prepreg (mm) | 0.09 | 0.14 | 0.09 | 0.09 | 0.09 | 0.09 |
| Specific gravity of prepreg (g/cm$^2$) | 1.48 | 1.72 | 1.67 | 1.48 | 1.50 | 1.46 |
| Resin content of prepreg (% by mass) | 45 | 16 | 17 | 53 | 58 | 65 |

[Evaluation Methods]

[Production of Resin Tensile Test Piece and Test Piece for Methyl Ethyl Ketone Swelling Test]

The matrix resin composition was dissolved in methyl ethyl ketone to produce an MEK solution of an epoxy resin. The MEK content of the MFK solution was 30% by mass. The MEK solution was dried, and melted by heating. The curing agent and the curing auxiliary agent were added thereto, and the mixture was stirred. A 2-mm-thick casting mold was filled with the obtained epoxy resin composition, and was processed at 130° C. for 2 hours to cure the epoxy resin composition. A test piece for a tensile test was molded in accordance with JIS-K7162 test piece 1BA from the cured resin plate. From the resin plate, a test piece having a square shape of 2 cm×2 cm was cut out. The test piece was used as a test piece for a methyl ethyl ketone swelling test.

[Test Piece for Tensile Test of Fiber-Reinforced Epoxy Resin Material]

The matrix resin composition was dissolved in methyl ethyl ketone to produce an MEK solution of an epoxy resin. The MEK content of the MEK solution was 30% by mass. Into the MEK solution, the curing agent and the curing auxiliary agent were added, and the resultant solution was stirred to prepare an epoxy resin composition solution. The epoxy resin composition solution was applied to a mold release paper, and dried at 80 to 90° C. for 3 minutes to obtain an epoxy resin composition sheet. A carbon fiber sheet having a mass per unit area of 100 g was impregnated with the obtained epoxy resin composition sheet by the hot melt method to obtain a prepreg having a carbon fiber content of 70% by mass. The obtained prepreg was cut, and the orientations of the fibers of ten sheets of the prepregs were aligned in one direction to obtain a laminate including ten sheets. The laminate was pressed on conditions of 80° C. for 30 minutes and 130° C. for 2 hours using a 1-mm spacer in a state where the laminate was sandwiched between 0.1-mm-thick mold release sheets. The epoxy resin was cured by the pressing and the heating to obtain a fiber-reinforced epoxy resin material sheet. The fiber-reinforced epoxy resin material sheet was cut so that a fiber vertical length was set to 100 mm and a width in a fiber direction was set to 10 mm, to obtain a test piece for a tensile test.

[Production of Pipe]

Figure 6:
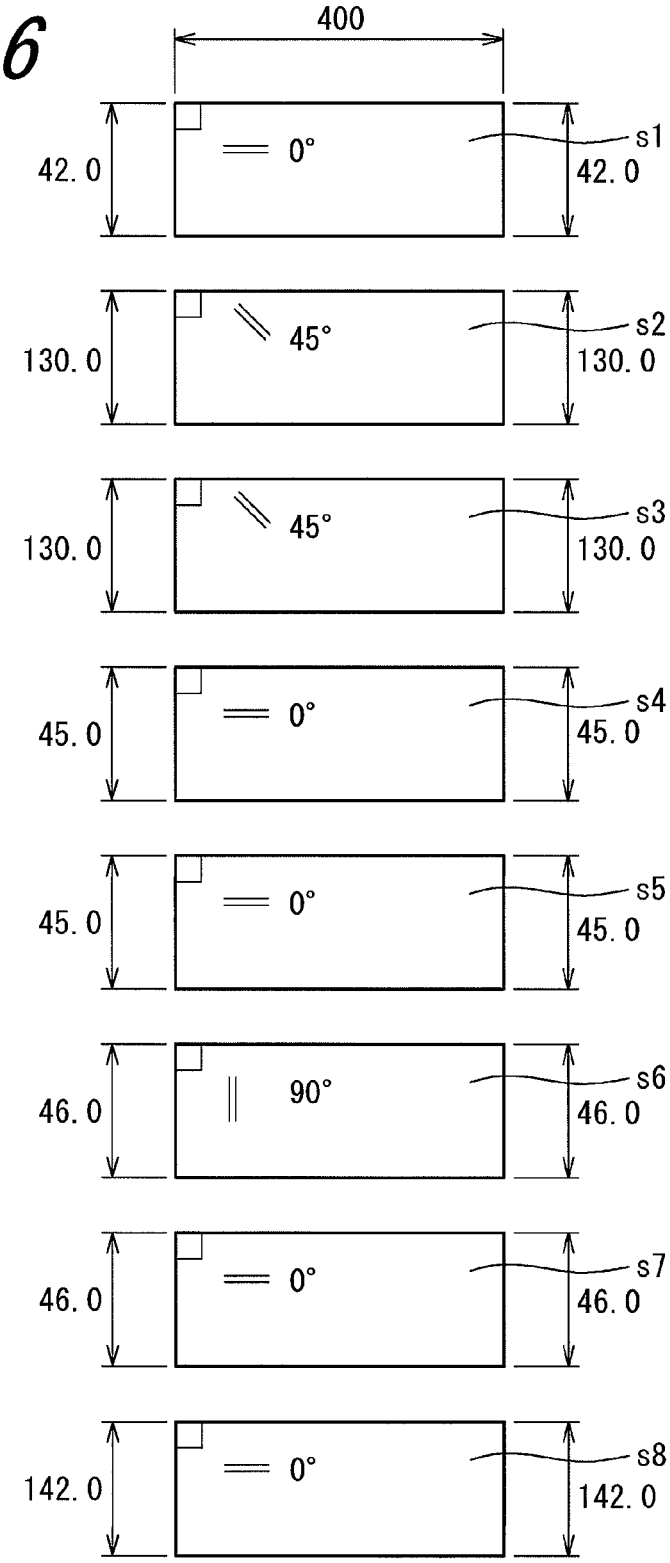
FIG. 6 is a developed view of a pipe according to example.
Figure 7:
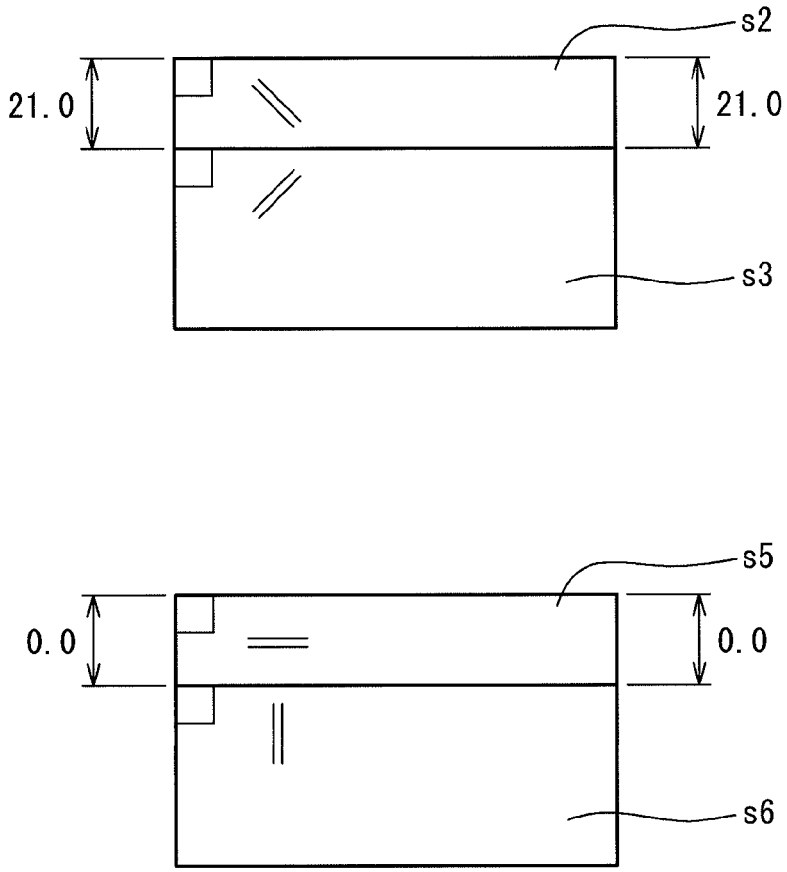
FIG. 7 is a plan view showing a united sheet according to the pipe of FIG. 6.

A pipe was produced by a sheet winding method using the prepregs P1 to P12. FIG. 6 is a developed view showing the laminate constitution of the pipe. As shown in FIG. 6, prepregs s1 to s8 were wound around a core bar (mandrel) in order. The prepreg s1 constitutes an innermost layer, and the prepreg s8 constitutes an outermost layer. The prepregs s1, s4, s5, s7, and s8 constitute straight layers. The prepreg s2 and s3 constitute bias layers. The prepreg s6 constitutes hoop layers. As shown in FIG. 7, the prepreg s2 and the prepreg s3 were stacked to obtain a united sheet. The prepreg s5 and the prepreg s6 were stacked to obtain a united sheet. The sheets to be stacked were wound in the state of the united sheet. A commercially available prepreg (manufactured by Toray Industries, Inc., TORAYCA prepreg P8055-3) was used as the prepreg s6. A curing process was performed by heating in a state where a wrapping tape was wound on the outer peripheral surface of the obtained winding body. A winding condition and a curing condition will be described below. The units of sizes described in FIGS. 6 and 7 are mm.

Winding Condition: Rolling Speed: 34 Hz

Wrapping Tape: manufactured by Shin-Etsu Chemical Co., Ltd., PT-30H, tension of 6000±100 gf Pitch: 2.0 mm Rotation Number of Main Shaft: 1870 to 1890 Hz Curing Conditions:

(1) Rising temperature from room temperature to 80° C. in 30 minutes (2) Holding at 80° C.±5° C. for 30 minutes±5 minutes (3) Rising temperature from 80° C. to 130° C. in 30 minutes (4) Holding at 130° C.±5° C. for 120 minutes±5 minutes The prepreg sheet was changed and pipes 1 to 25 were produced. For example, in the pipe 1, the prepreg P1 was used for sheets s1 to s5 respectively. "P805S-3" was used for a sheet s6. The prepreg P1 was used for sheets s7 and s8 respectively. The specifications and evaluation results of these pipes are shown in following Tables 5, 6, and 7.

TABLE 5

Specifications and evaluation results of pipes

| Sheet | Pipe 1 | Pipe 2 | Pipe 3 | Pipe 4 | Pipe 5 | Pipe 6 | Pipe 7 | Pipe 8 | Pipe 9 |
|---|---|---|---|---|---|---|---|---|---|
| s1 | P1 | P2 | P3 | P4 | P5 | P3 | P1 | P6 | P7 |
| s2 | P1 | P2 | P3 | P4 | P5 | P3 | P1 | P6 | P7 |
| s3 | P1 | P2 | P3 | P4 | P5 | P3 | P1 | P6 | P7 |
| s4 | P1 | P2 | P3 | P4 | P5 | P3 | P1 | P6 | P7 |
| s5 | P1 | P2 | P3 | P4 | P5 | P3 | P1 | P6 | P7 |
| s6 | P805S-3 | P805S-3 | P805S-3 | P805S-3 | P805S-3 | P805S-3 | P805S-3 | P805S-3 | P805S-3 |
| s7 | P1 | P2 | P3 | P4 | P5 | P1 | P3 | P6 | P7 |
| s8 | P1 | P2 | P3 | P4 | P5 | P1 | P3 | P6 | P7 |
| Three-point bending strength (N) | 2050 | 2210 | 2390 | 2210 | 2100 | 2110 | 2360 | 1680 | 1810 |
| Weight (g) | 34.0 | 34.0 | 34.0 | 34.0 | 34.0 | 34.0 | 34.0 | 31.7 | 31.7 |

TABLE 6

Specifications and evaluation results of pipes

| Sheet | Pipe 10 | Pipe 11 | Pipe 12 | Pipe 13 | Pipe 14 | Pipe 15 | Pipe 16 | Pipe 17 |
|---|---|---|---|---|---|---|---|---|
| s1 | P6 | P6 | P6 | P6 | P6 | P7 | P7 | P1 |
| s2 | P6 | P6 | P6 | P6 | P6 | P7 | P7 | P1 |
| s3 | P6 | P6 | P6 | P6 | P6 | P7 | P7 | P1 |
| s4 | P6 | P6 | P6 | P6 | P6 | P7 | P7 | P1 |
| s5 | P6 | P6 | P6 | P6 | P6 | P7 | P7 | P1 |
| s6 | P805S-3 | P805S-3 | P805S-3 | P805S-3 | P805S-3 | P805S-3 | P805S-3 | P805S-3 |
| s7 | P1 | P2 | P3 | P4 | P5 | P1 | P3 | P7 |
| s8 | P1 | P2 | P3 | P4 | P5 | P1 | P3 | P7 |
| Three-point bending strength (N) | 1950 | 2130 | 2210 | 2150 | 2010 | 1990 | 2250 | 1820 |
| Weight, (g) | 32.4 | 32.4 | 32.4 | 32.4 | 32.4 | 32.4 | 32.4 | 33.3 |

TABLE 7

Specifications and evaluation results of pipes

| Sheet | Pipe 18 | Pipe 19 | Pipe 20 | Pipe 21 | Pipe 22 | Pipe 23 | Pipe 24 | Pipe 25 |
|---|---|---|---|---|---|---|---|---|
| s1 | P10 | P11 | P12 | P7 | P7 | P2 | P4 | P2 |
| s2 | P10 | P11 | P12 | P7 | P7 | P2 | P4 | P2 |
| s3 | P10 | P11 | P12 | P7 | P7 | P2 | P4 | P2 |
| s4 | P10 | P11 | P12 | P7 | P7 | P2 | P4 | Commercial item A |
| s5 | P10 | P11 | P12 | P7 | P7 | P2 | P4 | Commercial item A |
| s6 | P805S-3 | P805S-3 | P805S-3 | P805S-3 | P805S-3 | P805S-3 | P805S-3 | P805S-3 |
| s7 | P3 | P3 | P3 | P9 | P8 | Commercial item A | Commercial item A | Commercial item A |
| s8 | P3 | P3 | P3 | P9 | P8 | Commercial item A | Commercial item A | Commercial item A |

TABLE 7-continued

| Specifications and evaluation results of pipes | | | | | | | | |
|---|---|---|---|---|---|---|---|---|
| Sheet | Pipe 18 | Pipe 19 | Pipe 20 | Pipe 21 | Pipe 22 | Pipe 23 | Pipe 24 | Pipe 25 |
| Three-point bending strength (N) | 2160 | 2060 | 1910 | 2310 | 2400 | 2080 | 2080 | 2070 |
| Weight (g) | 32.5 | 32.8 | 32.1 | 33.0 | 40.1 | 34.0 | 34.0 | 34.0 |

A commercially available prepreg A was used for prepreg s7 and s8 in the pipes 23 and 24. The commercially available prepreg A was used for prepregs s4, s5, s7, and s8 in the pipe 25. "P2253s-10" (brand name) manufactured by Toray Industries, Inc. was used as the prepreg A. In the P2253s-10, a carbon fiber is T800SC, and a resin content is 30% by mass.

[Methyl Ethyl Ketone Swelling Test]

The test piece for the methyl ethyl ketone swelling test was immersed in 100 mL of methyl ethyl ketone, and held at 40° C. for 48 hours. The mass of the test piece before and after the immersion was measured. The methyl ethyl ketone swelling ratio was calculated as follows.

$$\text{Swelling Ratio}=100\times[m1-m2]/m2$$

Herein, m1 is the mass of the test piece after the swelling test, and m2 is the mass of the test piece before the swelling test.

[Tensile Test]

Figure 8A:
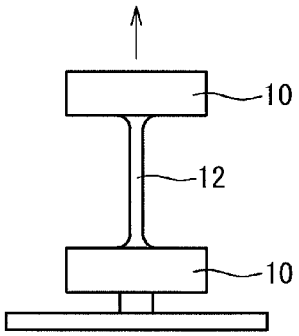
FIGS. 8A, 8B, and 8C describe a tensile test.
Figure 8B:
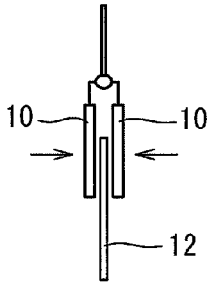
Figure 8C:
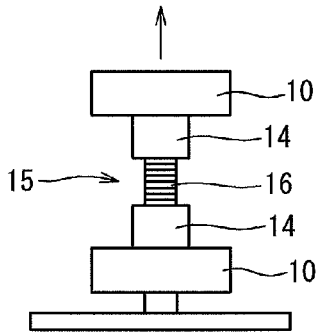

FIGS. 8A and 8B show a method for a tensile test of a cured product of the epoxy resin composition. FIG. 8C shows a method for a tensile test of a fiber-reinforced epoxy resin material. These tensile tests were performed at 1 mm/min of a tensile speed using Shimadzu Autograph manufactured by Shimadzu Corporation.

FIG. 8A is an illustration schematically showing a tensile test method for a test piece 12 made of the cured product of the epoxy resin composition. FIG. 8B is a side view of a chuck 10 holding the test piece 12 in FIG. 8A. Although nonslip unevenness is provided inside the chuck 10, the unevenness is not illustrated in FIG. 8B. FIG. 8C is an illustration schematically showing a tensile test method for the fiber-reinforced epoxy resin material. In FIGS. 8A and 8C, an arrow direction is a direction of the tensile test. As shown in FIG. 8C, an aluminum tag 14 was applied on a test piece 15 made of the fiber-reinforced epoxy resin material. A cyanoacrylate-based adhesive was used for the application. The aluminum tag 14 had a length of 4 mm, a width of 1.5 mm, and a thickness of 0.5 mm. The test was performed in a state where the test piece 15 was pulled in a direction vertical (90 degrees) to the orientation direction of a reinforced fiber 16.

The strength of the cured product of the epoxy resin composition was shown by a maximum stress×an elongation at that time/2 (MPa·%). The results are shown in Table 2. The strength of the fiber-reinforced epoxy resin material was showed by the maximum stress (MPa). The results are shown in Table 2.

[Three-Point Bending Strength]

Figure 9:
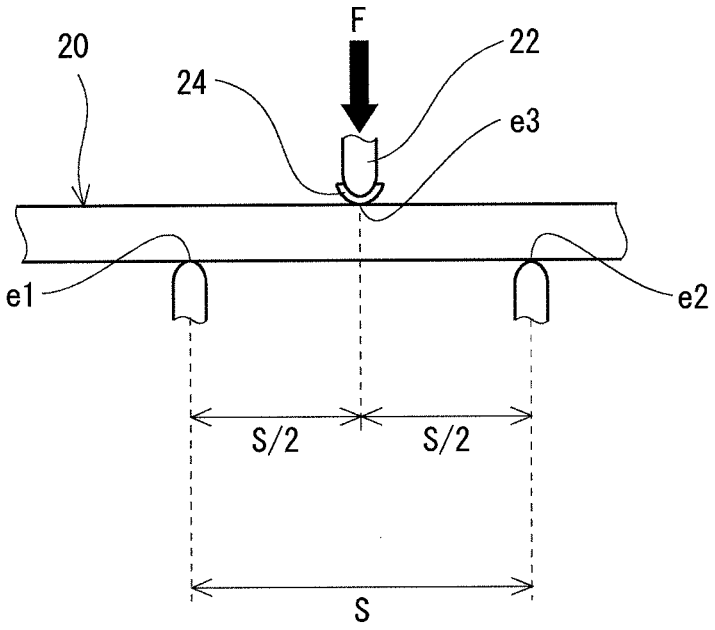
FIG. 9 describes a three-point bending test.

A three-point bending strength was measured based on an SG type three-point bending strength test defined by Consumer's Product Safety Association, Japan. Shimadzu Autograph manufactured by Shimadzu Corporation was used as a measuring device. FIG. 9 shows a method for measuring the three-point bending strength. As shown in FIG. 9, a load F was applied downward from above at a load point e3 while a pipe 20 was supported from below at two supporting points e1 and e2. The load point e3 is placed at a position dividing a portion between the supporting points e1 and e2 into two equal parts. The load point e3 is a measuring point. The movement speed of the load point e3 was set to 20 mm/min. The measuring point was set to a central position in the longitudinal direction of the pipe 20. A span S was set to 300 mm. A value (peak value) of a load F when the pipe 20 was broken was measured. The measured values are shown in the Tables 5 to 7.

Raw materials used for producing the matrix resin compositions and the prepregs are as follows.

jER828EL: bisphenol A type epoxy resin manufactured by Mitsubishi Chemical Corporation (epoxy equivalent: 184 to 194)

jER4005P: bisphenol F type epoxy resin manufactured by Mitsubishi Chemical Corporation (epoxy equivalent: 1070)

jER154: phenol novolac type epoxy resin manufactured by Mitsubishi Chemical Corporation (epoxy equivalent: 176 to 180)

Polyvinyl Formal: VINYLEC E manufactured by JNC Corporation

Dicyandiamide: DICY7 manufactured by Mitsubishi Chemical Corporation

Urea Derivative: DCMU-99 (3-(3,4-dichlorophenyl)-1,1-dimethyl urea) manufactured by Hodogaya Chemical Co., Ltd.

Methyl Ethyl Ketone: manufactured by Yoneyama Yakuhin Kogyo Co., Ltd.

Carbon Fiber: as described in Table 1

The results of Tables 5 to 7 show that if a novolac-containing layer is disposed outside, a shaft strength is likely to be improved. The advantages of the present invention are apparent.

The shaft described above can be applied to all golf clubs.

The description hereinabove is merely for an illustrative example, and various modifications can be made in the scope not to depart from the principles of the present invention.

What is claimed is:

1. A golf club shaft formed as a laminate comprising fiber-reinforced resin layers, wherein the golf club shaft has a plurality of full length fiber-reinforced resin layers that extend the entire axial length of the shaft;

the full length layers include full length bias layers and full length straight layers;

if a layer having a matrix resin including a novolac type epoxy resin is defined as a novolac-containing layer, the full length straight layers located radially outside the full length bias layers include a novolac-containing layer;

the matrix resin includes an epoxy resin component in the novolac-containing layer;

the novolac type epoxy resin is contained in the epoxy resin component is in an amount of 3% by mass or greater and 19% by mass or less;

if an average specific gravity of the novolac-containing layer is defined as S1, and an average specific gravity of the full length bias layers and any other layer located radially inside of the full length bias layers is defined as S2, the specific gravity S1 is greater than the specific gravity S2; and the novolac type epoxy resin is a phenol novolac type epoxy resin or an o-cresol novolac type epoxy resin.

2. The golf club shaft according to claim 1, wherein the full length straight layers include an outermost full length straight layer located on the radially outermost side among the full length layers; and the outermost full length straight layer is a novolac-containing layer.

3. The golf club shaft according to claim 1, wherein N layers located on the outermost side among the full length straight layers are novolac-containing layers; and N is equal to or greater than 2.

4. The golf club shaft according to claim 3, wherein N is equal to or greater than 3.

5. The golf club shaft according to claim 1, wherein M full length straight novolac-containing that are all located on the radially outermost side among the full length layers.

6. The golf club shaft according to claim 1, wherein a fiber elastic modulus of the a novolac-containing layer located radially outside the full length bias layers has a fiber elastic modulus that is equal to or greater than 8 t/mm$^2$ and less than 38 t/mm$^2$; and a full length bias layer has a fiber elastic modulus that is 38 t/mm$^2$ or greater and 70t/mm$^2$ or less.

7. The golf club shaft according to claim 6, wherein layers located inside the full length bias layers have a fiber elastic modulus that is 38 t/mm$^2$ or greater and 70 t/mm$^2$ or less.

8. The golf club shaft according to claim 1, wherein if a region located radially outside a boundary surface dividing a thickness of the shaft into two equal parts is defined as an outside region, and a region located radially inside the boundary surface is defined as an inside region, the outside region has a specific gravity that is greater than the inside region specific gravity.

9. The golf club shaft according to claim 1, further comprising a partial straight layer that extends a partial axial length of the shaft which reinforces a tip part of the shaft, wherein the partial straight layer is located radially outside a full length straight layer the that is a novolac-containing layer; and the partial straight layer has a matrix resin that includes a novolac type epoxy resin which is a phenol novolac type epoxy resin or an o-cresol novolac type epoxy resin.

10. The golf club shaft according to claim 2, wherein the novolac-containing layers located in the radially outermost part of the shaft have a total thickness that is 0.1 mm or greater and 0.8 mm or less.

11. The golf club shaft according to claim 5, wherein M is 2 or greater and 8 or less.

12. The golf club shaft according to claim 1, wherein the full length straight layers are fiber-reinforced resin layers wherein the fiber is oriented substantially in the axial direction of the shaft such that an orientation angle with respect to the axial direction is substantially zero.

13. The golf club shaft according to claim 1, wherein the full length straight layers are fiber-reinforced resin layers wherein the fiber is oriented substantially in the axial direction of the shaft such that an orientation angle with respect to the axial direction is ten degrees or less.

14. The golf club shaft according to claim 1, wherein full length bias layers include first and second fiber-reinforced resin layers, the fiber in the first resin layer is oriented at an angle of 15 degrees to 60 degrees with respect to the axial direction of the shaft, and the fiber in the second resin layer is oriented at an angle of 15 degrees to 60 degrees in an axially opposite direction as compared to the orientation angle of the fiber in the first resin layer.

15. The golf club shaft according to claim 1, wherein full length bias layers include first and second fiber-reinforced resin layers, the fiber in the first resin layer is oriented at an angle of 40 degrees to 50 degrees with respect to the axial direction of the shaft, and the fiber in the second resin layer is oriented at an angle of 40 degrees to 50 degrees in an axially opposite direction as compared to the orientation angle of the fiber in the first resin layer.

16. The golf club shaft according to claim 14, wherein the full length straight layers are fiber-reinforced resin layers wherein the fiber is oriented substantially in the axial direction of the shaft such that an orientation angle with respect to the axial direction is ten degrees or less.

* * * * *